US009967674B2

(12) United States Patent
Li et al.

(10) Patent No.: US 9,967,674 B2
(45) Date of Patent: May 8, 2018

(54) VIBRATION SYSTEM

(71) Applicants: Shuai Li, Shenzhen (CN); Fan Zhang, Shenzhen (CN)

(72) Inventors: Shuai Li, Shenzhen (CN); Fan Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days. days.

(21) Appl. No.: 15/383,013

(22) Filed: Dec. 19, 2016

(65) Prior Publication Data

US 2017/0353801 A1 Dec. 7, 2017

(30) Foreign Application Priority Data

Jun. 7, 2016 (CN) ..... 2016 2 0544393 U

(51) Int. Cl.
*H04R 1/00* (2006.01)
*H04R 9/02* (2006.01)
*H04R 9/06* (2006.01)

(52) U.S. Cl.
CPC ..... *H04R 9/022* (2013.01); *H04R 9/06* (2013.01)

(58) Field of Classification Search
CPC .... H04R 31/003; H04R 31/006; H04R 7/122; H04R 7/127; H04R 7/16; H04R 9/022; H04R 9/06
USPC ..... 381/397, 423, 430
See application file for complete search history.

(56) References Cited

U.S. PATENT DOCUMENTS

2007/0297640 A1* 12/2007 Ohashi ..... H04R 7/16 381/430

* cited by examiner

*Primary Examiner* — Sunita Joshi
(74) *Attorney, Agent, or Firm* — Na Xu; IPro, PLLC

(57) ABSTRACT

A vibration system is disclosed. The vibration system includes a vibrating diaphragm including a dome part and a suspension part encircling the dome part; a voice coil for driving the vibration diaphragm; and a heat conduction plate located between and connected with the dome part and the suspension part. The heat conduction plate includes a lower surface connecting with the voice coil and an upper surface opposite to the lower surface. The suspension part includes an internal peripheral part connected with the heat conduction plate, the dome part comprises a joint part connected with the heat conduction plate, and the upper surface of the heat conduction plate is at least partially exposed outside.

7 Claims, 2 Drawing Sheets

VIBRATION SYSTEM

FIELD OF THE INVENTION

The present invention relates to the technical field of electrical-acoustic convertors, especially to a vibration system used in a miniature loudspeaker.

DESCRIPTION OF RELATED ART

In recent years, with rapid development of information technology and increasingly higher popularizing rate of audio equipment, people's requirements for audio equipment are not only limited to video audio playback, but also extending to audio equipment reliability. Especially with 4G era coming, mobile multimedia technology develops accordingly, and a lot of terminals have various entertainment functions, such as video playback, digital camera, games and GPS navigation, which require more sophisticated and compact electronic components within the audio equipment.

A loudspeaker is an important component of electronic products with multimedia function, and its vibration system has great impact on the acoustic performance and stability. A general vibration system comprises a vibration diaphragm and a voice coil driving the diaphragm to vibrate. Once the vibration system vibrates, the electrified voice coil generates heat, and as the loudspeaker power increasing, the voice coil generates more and more heat. Without timely heat dissipation, the heat accumulation will cause the voice coil overheating and then heat from the voice coil conducts to the vibration diaphragm, which affects the vibration diaphragm's rigidity and causes vibration diaphragm softening and damage, and further affects loudspeaker's acoustic performance and stability, thus becoming influential factor in increasing loudspeaker power.

Therefore, it is necessary to provide an improved vibration system to overcome above disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiments described hereby is only to explain this disclosure, not intended to limit this disclosure.

Figure 1:
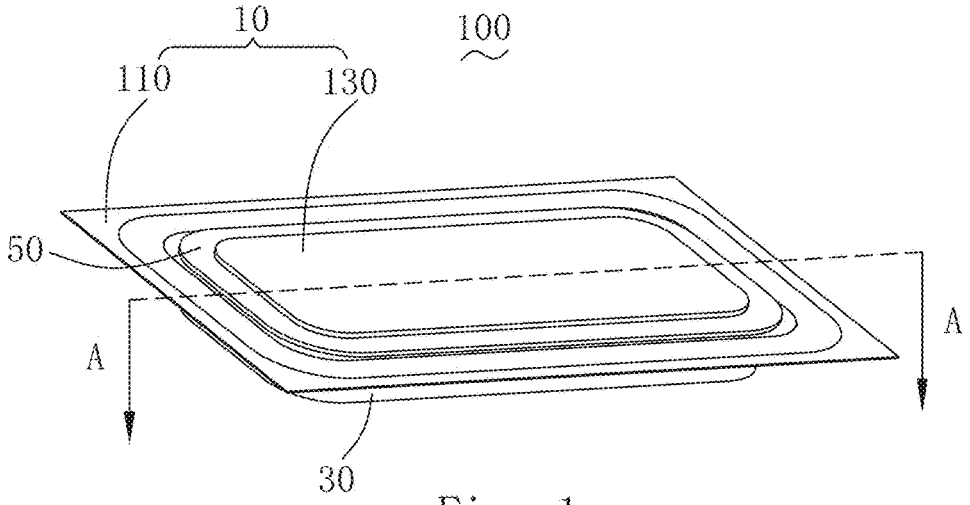
FIG. 1 is an isometric view of a vibration system in accordance with an exemplary embodiment of the present disclosure.
Figure 2:
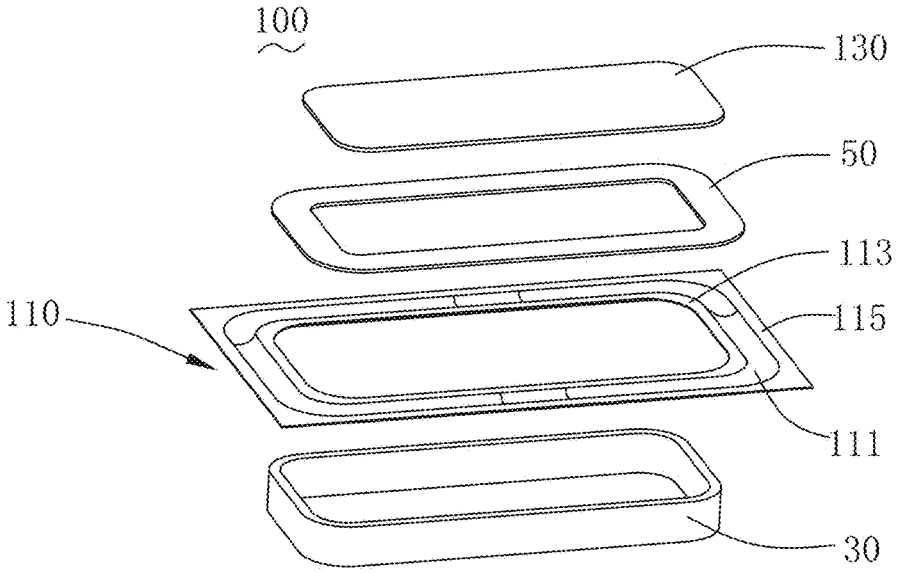
FIG. 2 is an isometric and exploded view of the vibration system in FIG. 1.
Figure 3:
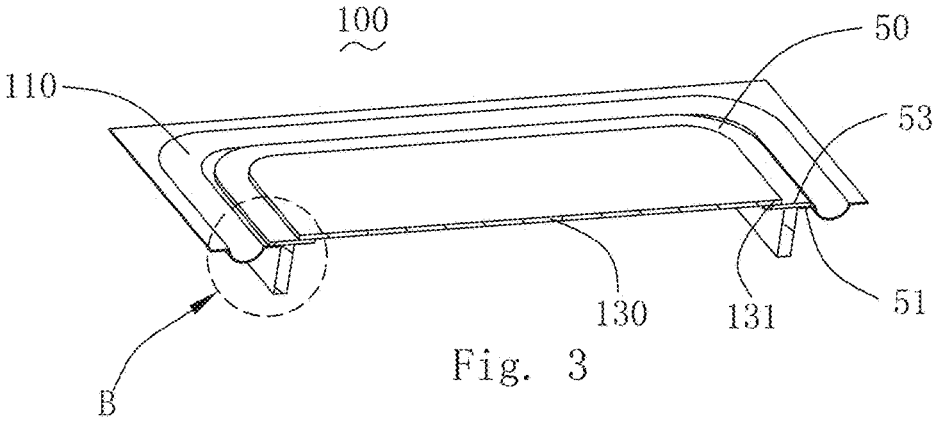
FIG. 3 is a cross-sectional view of the vibration system, taken along line A-A in FIG. 1.

Referring to FIGS. 1-3, a vibration system 100 comprises a vibration diaphragm 10, a voice coil 30 driving the vibrating diaphragm 10, and a heat conduction plate 50 using for heat radiation. The vibration diaphragm 10 and the voice coil 30 are respectively connected with the heat conduction plate 50.

The vibration diaphragm 10 comprises a suspension part 110 and a dome part 130. The suspension part 110 encircles the dome part 130. The suspension part 110 includes a lug 111, an internal peripheral part 113 extending from both sides of the lug 111, and an external peripheral part 115. The lug 111 raises towards the direction approaching the voice coil 30, and the internal peripheral part 113 is connected with the heat conduction plate 50. The dome part 130 includes a joint part 131 provided in its periphery and connected with the heat conduction plate 50. The suspension part 110 and the dome part 130 are respectively fixed on the heat conduction plate 50, and specifically the internal peripheral part 113 of the suspension part 110 and the joint part 131 of the dome part 130 are respectively fixed on the heat conduction plate 50.

The voice coil 30 is used for driving the vibration diaphragm 10 to vibrate and generates heat after being electrified, and with greater loudspeaker power, the voice coil 30 generates more heat, which effectively solves the heat dissipation problem of the voice coil 30 and further increase loudspeaker's power and performance. In the embodiment, the voice coil 30 is a rectangular frame structure.

The heat conduction plate 50 is located between and connected with the dome part 130 and the suspension part 110. The heat conduction plate 50 has a lower surface 51 near the voice coil 30 and an upper surface 53 opposite to the lower surface 51. The heat conduction plate 50 is used for radiating heat generated by the voice coil 30 and is made from thermal conductive material, and in order to ensure good heat dissipation, the upper surface 53 of the heat conduction plate 50 is at least partially exposed, namely incompletely covered, which can effectively dissipate the heat generated by the voice coil 30. In the embodiment, the heat conduction plate 50 is an aluminum heat conduction plate, because aluminum material is not only easy to dissipate heat but also has light weight and good stiffness, which has little impact on the overall weight of the vibration system 100.

Figure 4:
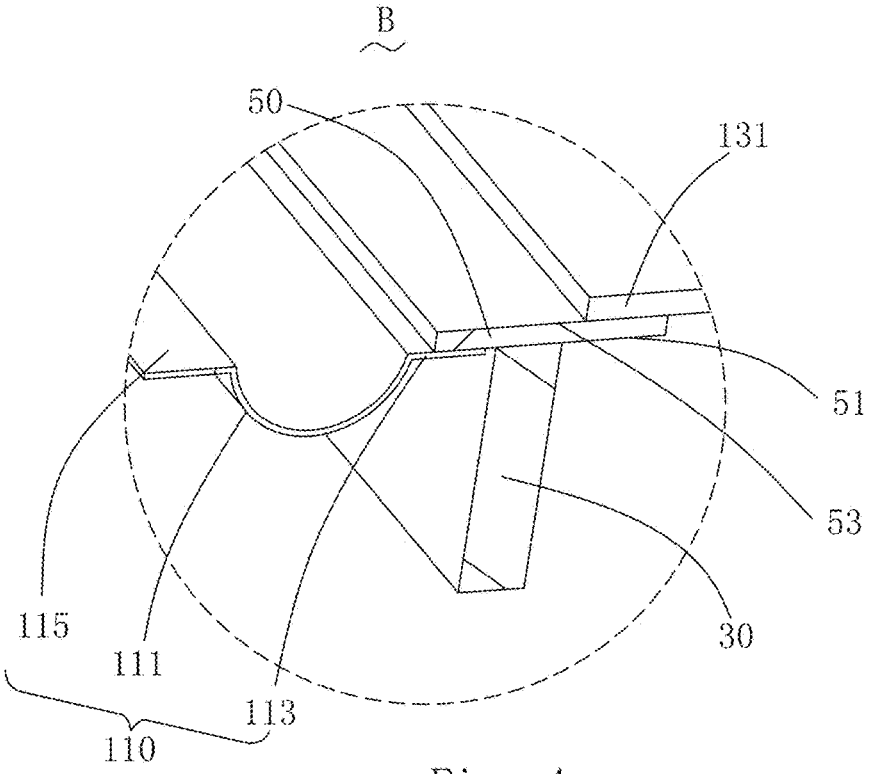
FIG. 4 is an enlarged view of Part B in FIG. 3.

Referring to FIG. 4, the suspension part 110, the dome part 130 and the voice coil 30 are respectively connected to the conduction plate 50, specifically, the voice coil 30 is fixed on the lower surface 51 of the conduction plate 50, the internal peripheral part 113 of the suspension part 110 is fixed on the lower surface 51 or upper surface 53 of the heat conduction plate 50, and the joint part 131 of the dome part 130 is fixed on the lower surface 51 or upper surface 53 of the heat conduction plate 50, namely there are four cases as following: the internal peripheral part 113 and the joint part 131 are simultaneously fixed to the lower surface 51 of the heat conduction plate 50; the internal peripheral part 113 and the joint part 131 are simultaneously fixed to the upper surface 53 of the heat conduction plate 50; the internal peripheral part 113 is simultaneously fixed to the upper surface 53 of the heat conduction plate 50, and the joint part 131 is fixed on the lower surface 51 of the heat conduction plate 50; the internal peripheral part 113 is fixed to the lower surface 51 of the heat conduction plate 50, and the joint part 131 is fixed on the upper surface 53 of the heat conduction plate 50. In the embodiment, the internal peripheral part 113 is fixed on the lower surface 51 of the heat conduction plate 50, and the joint part 131 is fixed on the upper surface 53 of the heat conduction plate 50.

When the internal peripheral part 113 of the suspension part 110 and the joint part 131 are respectively fixed on the lower surface 51 of the heat conduction plate 50, the voice coil 30 is provided encircling the joint part 131, and the internal peripheral part 113 is provided encircling the voice coil 30, the upper surface 53 of the conduction plate 50 completely exposed will have better heat dissipation effect. When the internal peripheral part 113 of the suspension part 110 and the joint part 131 are respectively fixed on the upper surface 53 of the heat conduction plate 50, the internal peripheral part 113 encircles the joint part 131 and these two are provided at intervals, it is necessary to ensure the upper surface 53 of the heat conduction plate 50 partially exposed, to help heat dissipation of the voice coil 30 after being electrified.

In the embodiment, the suspension part 110, the dome part 130 and the voice coil 30 are respectively connected to the heat conduction plate 50 in a gluing way, i.e., the internal peripheral part 113, the joint part 131 and the voice coil 30 are connected to the heat conduction plate 50 in a gluing way.

The present disclosure also provides a loudspeaker, which includes aforementioned vibration system 100. The suspension part 110, the dome part 130 and the voice coil 30 are all provided on the heat conduction plate 50, the heat conduction plate 50 is made from thermal conductive material, and heat generated by the voice coil 30 is dissipated through the heat conduction plate 50, which effectively solves the technical problems of bad heat dissipation effect of the loudspeaker's vibration system 100, ensures the loudspeaker's acoustic stability, and further improves the loudspeaker's power.

The vibration system and loudspeaker using the vibration system according to present utility model has the following beneficial effects: add heat conduction plate 50 made from heat thermal conductive material, connect the suspension part 110, the dome part 130 and the voice coil 30 respectively with the heat conduction plate 50, and meanwhile ensure the upper surface 53 of the heat conduction plate 50 partially exposed at least, which can effectively dissipate the heat generated by the voice coil 30 after being electrified, keep the vibration system 100 in good dissipation effect, ensure acoustic stability of the loudspeaker using the vibration system 100, meanwhile properly solve the dissipation problem of the voice coil 30 and allow to further develop loudspeaker with higher power.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration system comprising:

a vibrating diaphragm including a dome part and a suspension part encircling the dome part;

a voice coil for driving the vibration diaphragm;

a heat conduction plate located between and connected with the dome part and the suspension part, the heat conduction plate including a lower surface connecting with the voice coil and an upper surface opposite to the lower surface; wherein the suspension part includes an internal peripheral part fixed on the heat conduction plate's lower surface or on the heat conduction plate's upper surface, the dome part comprises a joint part fixed on the heat conduction plate's lower surface or on the heat conduction plate's upper surface, and the upper surface of the heat conduction plate is at least partially exposed outside.

2. The vibration system as described in claim 1, wherein the internal peripheral part and the joint part are fixed on the heat conduction plate's lower surface, the voice coil encircles the dome part, and the internal peripheral part encircles the voice coil.

3. The vibration system as described in claim 1, wherein the internal peripheral part is fixed on the heat conduction plate's lower surface, and the joint part is fixed on the heat conduction plate's upper surface, the internal peripheral part encircles the voice coil.

4. The vibration system as described in claim 1, wherein the internal peripheral part and the joint part are fixed on the heat conduction plate's upper surface, the internal peripheral part encircles the dome part.

5. The vibration system as described in claim 1, wherein the internal peripheral part is fixed on the heat conduction plate's upper surface, and the joint part is fixed on the heat conduction plate's lower surface, the voice coil encircles the dome part.

6. The vibration system as described in claim 1, wherein the voice coil, the internal peripheral part and the joint part are glued together with the heat conduction plate.

7. The vibration system as described in claim 1, wherein the heat conduction plate is aluminum heat conduction plate.

* * * * *